US006053770A

United States Patent [19]

Blom

[11] Patent Number: 6,053,770

[45] Date of Patent: Apr. 25, 2000

[54] CABLE ASSEMBLY ADAPTED WITH A CIRCUIT BOARD

[75] Inventor: Hans Arie Blom, Portland, Oreg.

[73] Assignee: The Whitaker Corporation, Wilmington, Del.

[21] Appl. No.: 09/114,804

[22] Filed: Jul. 13, 1998

[51] Int. Cl.[7] ..... H01R 9/05

[52] U.S. Cl. ..... 439/579; 439/497

[58] Field of Search ..... 439/497, 579, 439/493, 581

[56] References Cited

U.S. PATENT DOCUMENTS

| | | | |
|---|---|---|---|
| 4,762,500 | 8/1988 | Dola et al. | 439/79 |
| 5,387,125 | 2/1995 | Davis et al. | 439/497 |
| 5,470,238 | 11/1995 | Walden | 439/98 |
| 5,556,300 | 9/1996 | Parker | 439/497 |
| 5,580,271 | 12/1996 | Buchheister, Jr. et al. | 439/493 |
| 5,618,202 | 4/1997 | Okuyama et al. | 439/497 |

*Primary Examiner*—Michael L. Gellner
*Assistant Examiner*—Briggitte Hammond

[57] ABSTRACT

An electrical cable assembly (1) is adapted with a circuit board (9) for connection of a pin connector (2) to a cable (2), and wherein, signal pins (5) of the connector (2) connect to contact pads (10) on a first side (11) of the circuit board (9), insulated conductors (7) of the cable (2) connect to contact pads (10') on a second side (12) of the circuit board (9), and ground pins (6) of the connector (2) and conducting shields (18) on the insulated conductors (7) connect to a ground plane (14) on the circuit board (9).

20 Claims, 6 Drawing Sheets

CABLE ASSEMBLY ADAPTED WITH A CIRCUIT BOARD

FIELD OF THE INVENTION

The invention relates to an electrical cable assembly wherein an electrical cable assembly is connected to an electrical connector.

BACKGROUND OF THE INVENTION

A known electrical cable assembly, described in U.S. Pat. No. 5,580,271, has an electrical cable connected to an electrical connector. The connector has electrical contacts with solder tails adapted for connection with insulated, signal transmitting conductors of the cable. The electrical contacts in the known connector are springs engaged against the signal transmitting conductors with spring forces. A circuit board has contact pads connected to both the solder tails and the signal transmitting conductors.

A disadvantage of the known cable assembly is that it requires electrical contacts with springs on the solder tails, which are unsuitable for plugging into apertures of a circuit board. In the past, two types of electrical connectors have been required. One type is suited for connection to an electrical cable, by having springs on the solder tails for connection to signal transmitting conductors of the cable. Another type of electrical connector is suitable for mounting on a circuit board, by having signal pins and ground pins that plug into apertures of the circuit board. The signal pins and ground pins are unsuited for connection to an electrical cable. In the past a need for two different types of solder tails resulted in two types of electrical connectors being required.

A desired electrical connector is one that has solder tails of one type, which solder tails are readily adapted for connection, either to an electrical cable, or to apertures in a circuit board.

SUMMARY OF THE INVENTION

According to the invention, an electrical cable assembly is connected to an electrical connector of the type having signal pins and ground pins for solder tails that plug into apertures, and the signal pins are adapted with a circuit board to connect the signal pins with signal transmitting conductors of the cable. The invention eliminates the past need for connectors with different types of solder tails depending upon whether the solder tails connect to a circuit board or to an electrical cable.

The circuit board is in a space beside the signal pins, which provides a compact construction and a reduced length of signal transmission, and reduced insertion loss characteristics due to the circuit board in the signal transmission paths through the connector. The circuit board has a ground plane with ground pads extending beside the signal paths to control impedance.

DESCRIPTION OF THE DRAWINGS

Embodiments of the invention will now be described by way of example with reference to the accompanying drawings, according to which.

DETAILED DESCRIPTION

Figure 3:
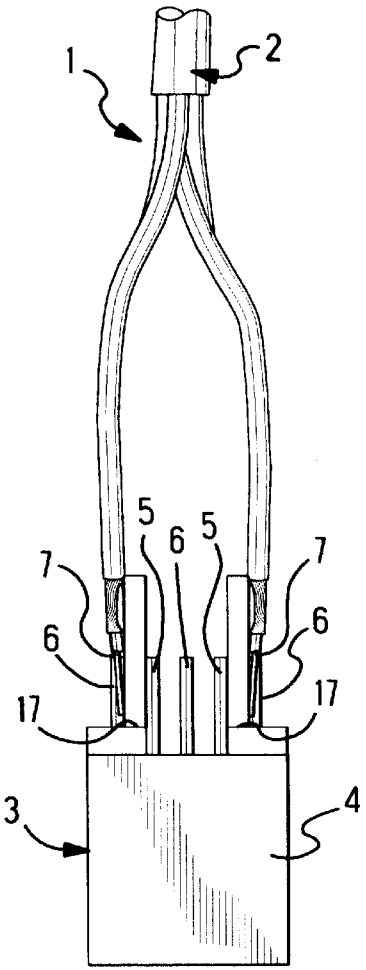
FIG. 3 is an end view of the structure shown in FIG. 1.
Figure 15:
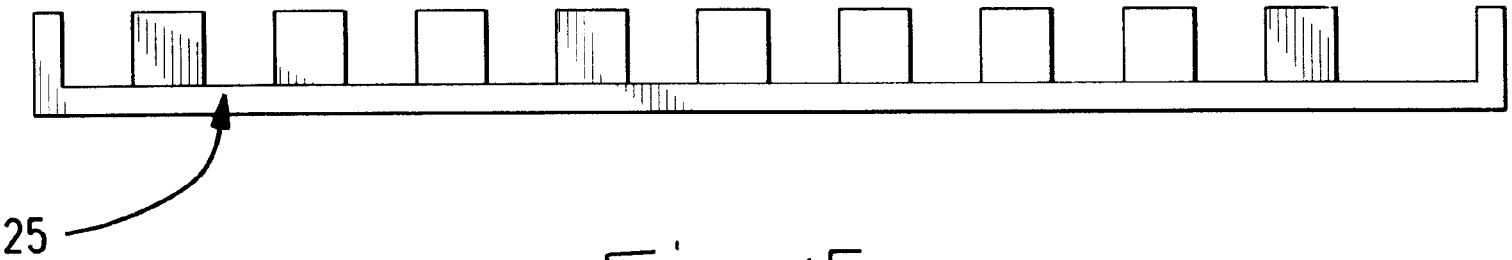
FIG. 15 is a front view of the cover shown in FIG. 12.

With reference to FIGS. 3 and 15, an electrical cable assembly 1 comprises, an electrical cable 2 connected to an electrical connector 3, the connector 3 being of the type having electrical contacts, not shown, in an insulating housing 4. Signal pins 5 and ground pins 6 are on respective electrical contacts, the pins 5, 6 being of a type for plugging into apertures of a circuit board, not shown. Electrical signals are transmitted by the signal pins 5 and by insulated, signal transmitting conductors 7 of the electrical cable 2. The ground pins 6 connect to earth or ground electrical potential. Further details of the electrical connector 3 are described in U.S. Pat. No. 4,762,500, incorporated herein by reference.

Figure 1:
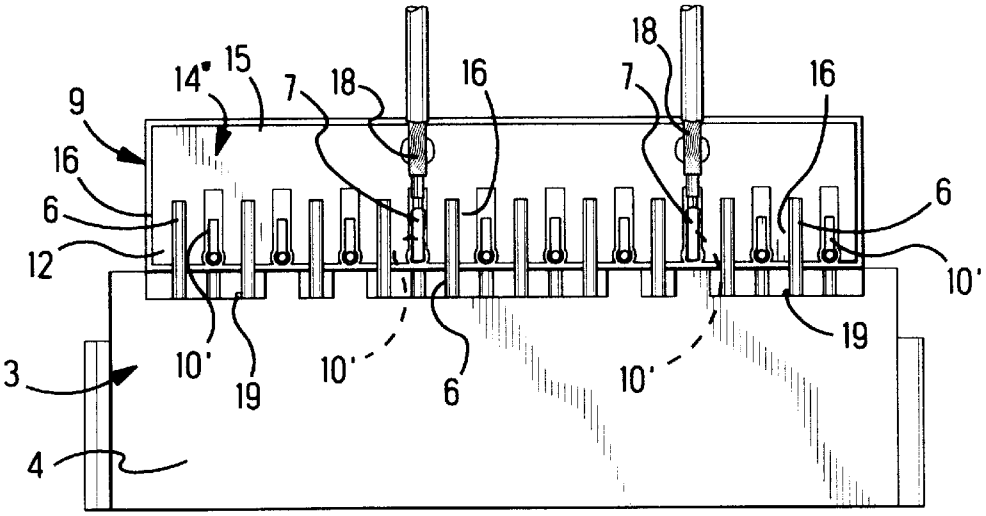
FIG. 1 is a view of an electrical connector adapted with a circuit board for connection to a cable.
Figure 4:
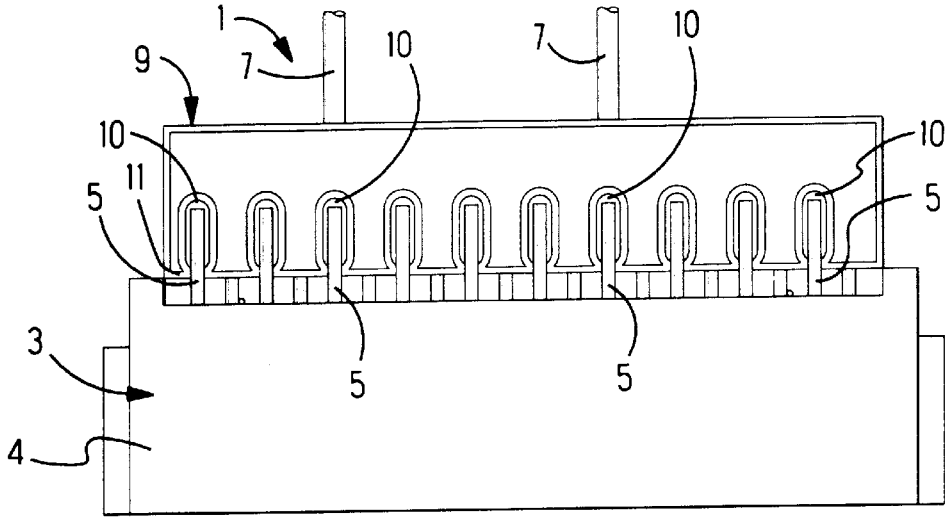
FIG. 4 is a rear view of the structure shown in FIG. 1.
Figure 5:
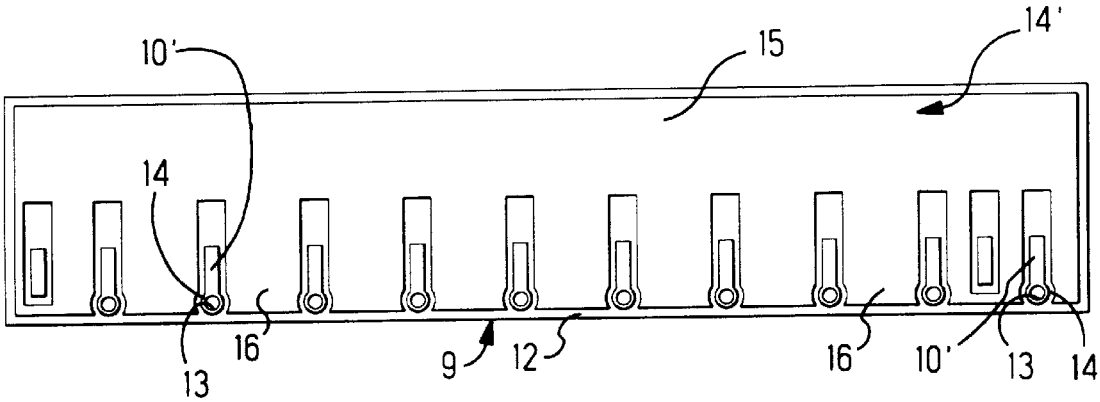
FIG. 5 is a view of a second side of a circuit board.
Figure 6:
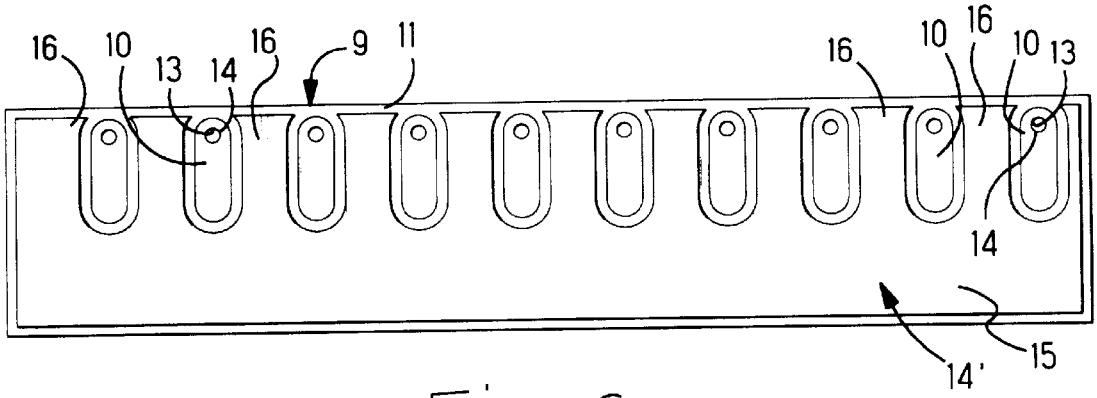
FIG. 6 is a view of a first side of the circuit board as shown in FIG. 5.
Figure 7:
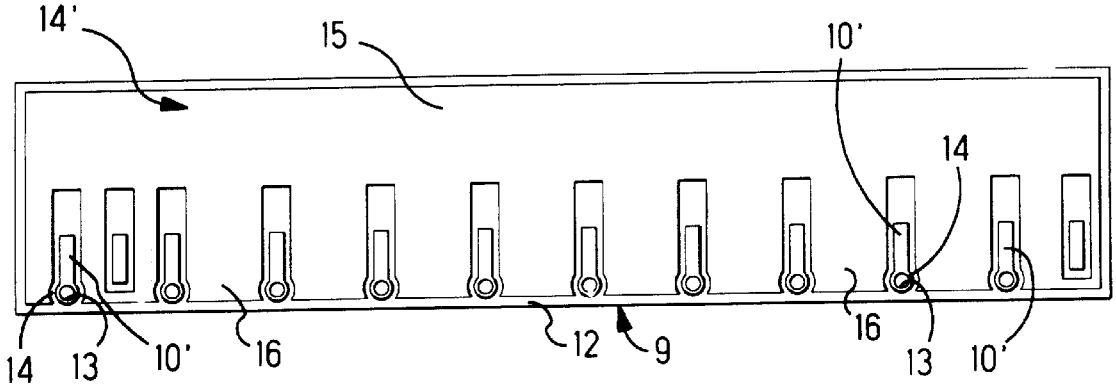
FIG. 7 is a view similar to FIG. 5 of a second side of another embodiment of a circuit board.
Figure 8:
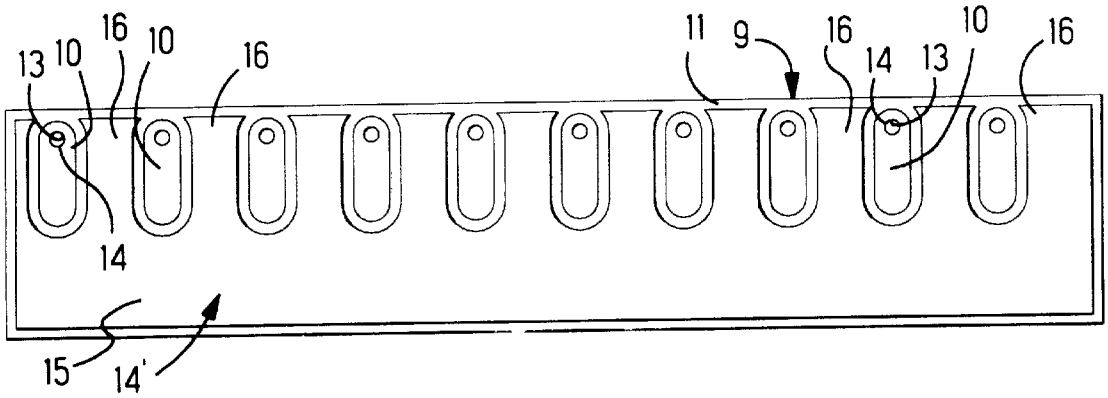
FIG. 8 is a view of a first side of the circuit board shown in FIG. 7.
Figure 9:
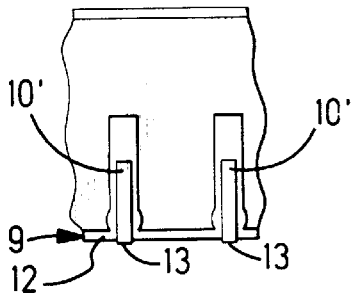
FIG. 9 is a view of a portion of a circuit board.
Figure 10:
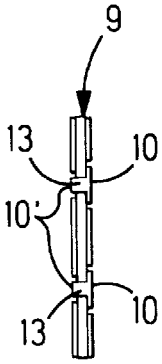
FIG. 10 is a view of an edge of the circuit board shown in FIG. 9.
Figure 11:
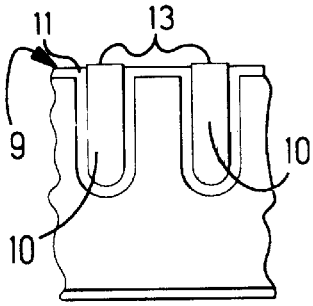
FIG. 11 is a rear view of a portion of the circuit board shown in FIG. 9.

With reference to FIGS. 1 and 4, each row of the signal pins 5, that is present on the electrical connector 3, is adapted with a circuit board 9 for connection to the signal transmitting conductors 7 of the cable 2, wherein, the row of the signal pins 5 connect to a row of contact pads 10, FIG. 4, on a first side 11 of the circuit board 9. The contact pads 10 on the first side 11 are aligned with the signal pins 5 of the row. The signal transmitting conductors 7 of the electrical cable 2 connect to contact pads 10', FIG. 1, on a second side 12 of the circuit board 9. A single circuit board 9 is sufficient to connect with one row of signal pins 5 that is present on the electrical connector 3. In the embodiment shown in FIGS. 2 and 3, two rows of signal pins 5 are present. The description herein, refers to any one row of signal pins 5 that is present in the electrical connector 3, which row of signal pins 5 is connected with contact pads 10 on a corresponding circuit board 9.

With reference to FIGS. 5–11, conducting circuit paths 13 extend across a thickness of the circuit board 9. The circuit paths 13 connect with the contact pads 10 on the first side 11, and connect with the contact pads 10' on the second side 12. According to each of the embodiments shown in FIGS. 5–7, the conducting circuit paths 13 comprise conducting lining within respective apertures 14 through the circuit board 9. According to an embodiment shown in FIGS. 9–11, the conducting circuit paths 13 extend across an edge of the circuit board 9.

As described hereafter, a controlled impedance electrical path is established along each signal pin 5 that is connected to a contact pad 10, in turn, connected to a conducting circuit path 13, in turn, connected to a contact pad 10', in turn, connected to a signal transmitting conductor 7 of the electrical cable 2.

The ground pins 6 of the electrical connector 3, that are in a row of the ground pins 6, are adapted with the circuit board 9. With reference to FIGS. 5–8, a corresponding ground plane 14' is provided, in a known manner, to extend on both, the first side 11 and the second side 12 of the circuit board 9. An earth, or ground, electrical potential is provided in a known manner by the ground plane 14'. For example, the ground plane 14' on each of the first side 11 and the second side 12 is constructed with an elongated ground bus 15 that is unitary with ground pads 16 extending from the ground bus 15. The ground pads 16 extend between the contact pads 10, 10'. Each contact pad 10, 10' extends beside and parallel to a ground pad 16 to control the impedance of the above described, electrical path.

With reference to FIG. 1. the ground pins 6 in a row connect with the ground plane 14' on the second side 12 of the circuit board 9. Each ground pin 6 that is in alignment with a corresponding ground pad 16 is connected to the corresponding ground pad 16. For example, a row of the ground pins 6 extends along the second side 12 of the circuit board 9, with each of the ground pins 6 in the row being connected to respective ground pads 16 on the ground plane 14'.

With reference to FIG. 3, the circuit board 9 is in a space 17 that is beside the row of signal pins 5 and beside each of the ground pins 6 that connect with the ground plane 14' on the second side 12 of the circuit board 9. Placement of the circuit board 9 beside the pins 5, 6, in the space 17, provides a compact construction, and a reduced length of signal transmission, and reduced insertion loss characteristics due to the circuit board 9 in the signal transmission paths through the connector 3.

With reference to FIGS. 5–8, the circuit board 9 is fabricated in a known manner, with the ground plane 14' and the contact pads 10, 10', on both sides of the circuit board 9, being fabricated as conducting layers on the circuit board 9.

The contact pads 10 on the first side 11 of the circuit board 9 are coated with fluent solder that is solidified prior to connection with the signal pins 5. The ground pads 16 and the ground plane 14' on the second side 12 of the circuit board 9 are coated with fluent solder that is solidified prior to connection with the ground pins 6. The circuit board 9 is positioned in the space 17 beside the row of signal pins 5, and beside the ground pins 6 that are aligned with the ground pads 16 on the second side 12 of the circuit board 9. The solidified solder is thereafter subjected to a solder reflow operation, wherein, heat and pressure is applied to melt, or reflow, the solder and establish fused solder connections, respectively, of the contact pads 10 with the signal pins 5, and of the ground pads 16 with the ground pins 6.

The contact pads 10' on the second side 12 of the circuit board 9 are coated with fluent solder that is solidified prior to connection with the signal transmitting conductors 7. The signal transmitting conductors 7 protrude from their insulation and are aligned with the contact pads 10' on the second side 12 of the circuit board 9. The solidified solder on the contact pads 10' is subjected to a solder reflow operation, wherein, heat and pressure is applied to melt, or reflow, the solder and establish fused solder connections between the contact pads 10' and the signal transmitting conductors 7.

A preferred operation is to reflow the solder to connect the circuit board 9 with the pins 5, 6. Fused solder joints of the signal pins 5 with the contact pads 10, and the fused solder joint of the ground pins 16 with the ground pads 16, can be inspected prior to connection of the circuit board 9 with the signal transmitting conductors 7 of the cable 2.

The contact pads 10' on the second side 12 of the circuit board 9 are coated with fluent solder that is solidified prior to connection with the signal transmitting conductors 7. The signal transmitting conductors 7 protrude from their insulation and are aligned with the contact pads 10' on the second side 12 of the circuit board 9. The solidified solder on the contact pads 10' is subjected to a solder reflow operation, wherein, heat and pressure is applied to melt, or reflow, the solder and establish fused solder connections between the contact pads 10' and the signal transmitting conductors 7.

When the signal transmitting conductors 7 have respective conducting shields 18, FIG. 3, that encircle the signal transmitting conductors 7 to provide the signal transmitting conductors 7 with coaxial cable constructions, the sheaths 18 protrude from a remainder of the cable 2, and connect to the ground bus 15 portion on the ground plane 14' by a solder reflow operation. When it is desired to connect the sheaths 18 to the circuit board 9 prior to connecting the signal transmitting conductors 7 to the circuit board 9, the solder on the ground bus portion is selected with a relative, highest melting temperature, as compared with a melting temperature of the solder used to connect the signal transmitting conductors 7 to the circuit board 9.

Figure 2:
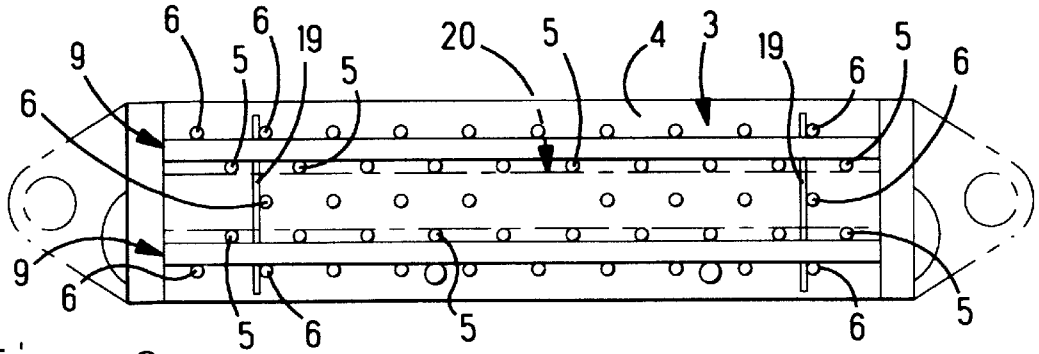
FIG. 2 is a top view of the structure shown in FIG. 1.
Figure 12:
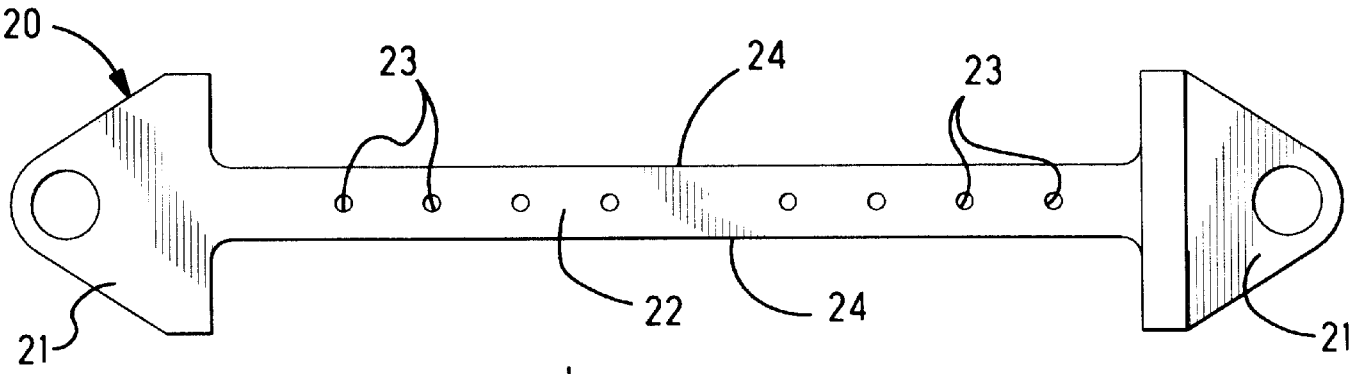
FIG. 12 is a top view of a mounting bracket.
Figure 13:
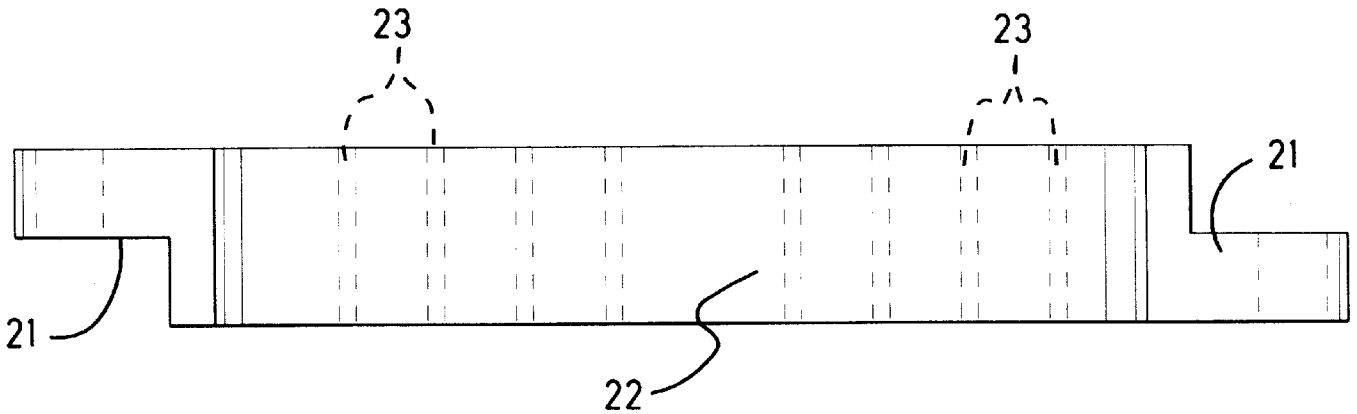
FIG. 13 is a front view of the structure shown in FIG. 12.
Figure 14:
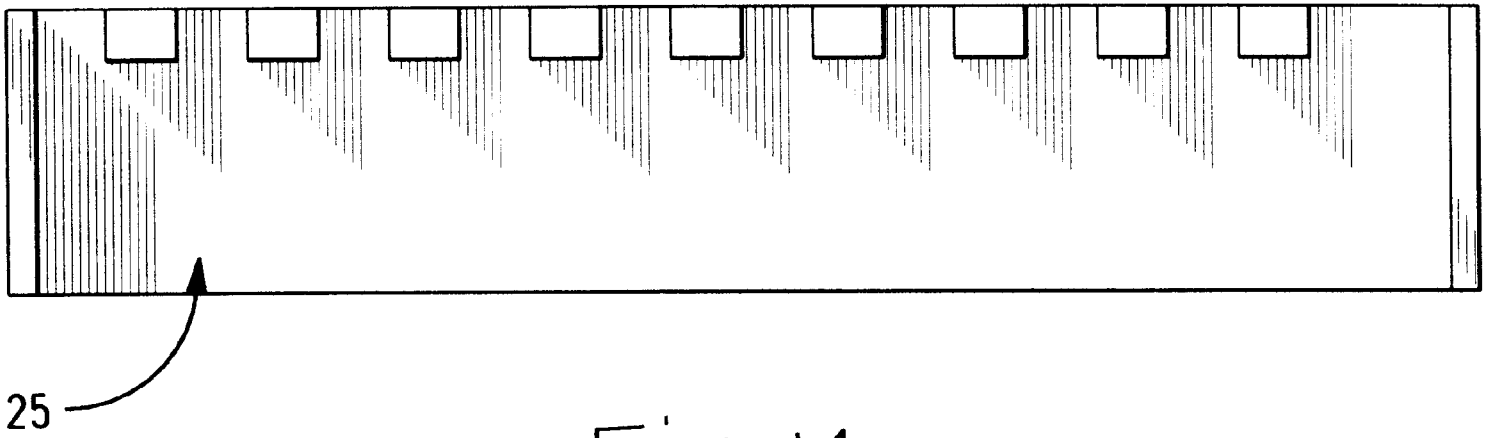
FIG. 14 is a top view of a cover.
Figure 16:
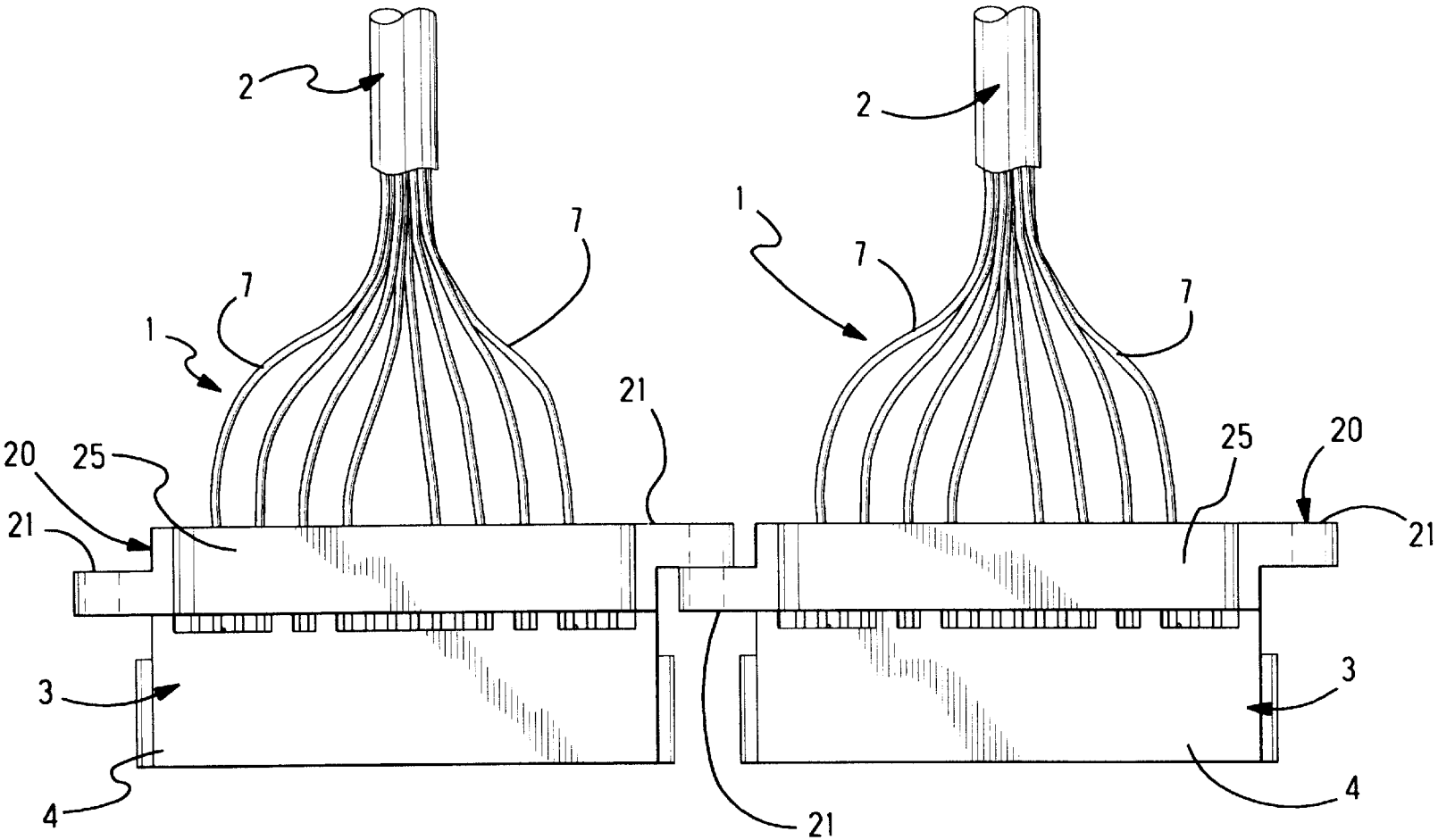
FIG. 16 is view of a cover on each of two electrical cable assemblies.

With reference to FIG. 2, a conducting jumper wire 19 connects one of the ground pins 6 that is connected with one of the ground pads 16 to another ground pin 6 in a row of such pins 6 that is spaced from the circuit board 9. With reference to FIGS. 12 and 13, a mounting bracket 20 has exterior, end mounting flanges 21 and a thin blade portion 22. The blade portion 22 fits in a space 17' beside the circuit board 9, FIG. 2. Passages 23 through the blade portion 22 fits over the ground pins 6 that are in the row that is spaced from the circuit board 9. Each circuit board 9 that is present on the connector 2 fits along a recess 24 beside the blade portion 22. An insulating cover 25, FIG. 16, is applied to each recess 24 to cover a circuit board 9 and its electrical connections to the pins 5, 6 and to the cable 2 that are along the recess 24.

Other embodiments and modifications of the invention are intended to be covered by the spirit and scope of the invention.

I claim:

1. An electrical cable assembly comprising:

an electrical cable connected to an electrical connector, a circuit board having a first side of the circuit board, the circuit board having a second side of the circuit board, the circuit board having a thickness of the circuit board, the circuit board having first contact pads that are on the first side of the circuit board, the circuit board having second contact pads that are on the second side of the circuit board, the thickness of the circuit board having conducting circuit paths that are on the thickness of the circuit board, the first contact pads that are on the first side of the circuit board being connected to the conducting circuit paths that are on the thickness of the circuit board, the conducting circuit paths that are on the thickness of the circuit board being connected to the second conducting pads that are on the second side of the circuit board, the circuit board having a ground plane that is on the circuit board, the electrical connector having a housing of the electrical connector, the electrical connector having signal pins of the electrical connector, the electrical connector having ground pins of the electrical connector, the ground pins of the electrical connector being connected to the ground plane that is on the circuit board, the signal pins of the electrical connector being connected to the first contact pads that are on the first side of the circuit board, the electrical cable having insulated signal transmitting conductors of the electrical cable, and the signal transmitting conductors of the electrical cable being connected to the second contact pads that are on the second side of the circuit board, whereby, the signal pins of the electrical connector are connected to the signal transmitting conductors of the electrical cable by having the signal pins of the electrical connector being connected to the first contact pads that are on the first side of the circuit board, and by having the first contact pads that are on the first side of the circuit board being connected to the conducting circuit paths that are on the thickness of the circuit board, and by having the conducting circuit paths that are on the thickness of the circuit board being connected to the second conducting pads that are on the second side of the circuit board, and by having the signal transmitting conductors of the electrical cable being connected to the second conducting pads that are on the second side of the circuit board.

2. An electrical cable assembly as recited in claim 1 wherein, the conducting circuit paths that on the thickness of the circuit board are on the thickness of the circuit board that is across an edge of the circuit board.

3. An electrical cable assembly as recited in claim 1 wherein, the conducting circuit paths that are on the thickness of the circuit board comprise conducting lining within apertures through the circuit board.

4. An electrical cable assembly as recited in claim 1 wherein, the ground plane that is on the circuit board has unitary ground pads that are unitary with the ground plane that is on the circuit board, the unitary ground pads that are unitary with the ground plane that is on the circuit board extend between the second contact pads that are on the second side of the circuit board, and the second contact pads that are on the second side of the circuit board extend beside and parallel to the unitary ground pads that are on the second side of the circuit board to control impedance.

5. An electrical cable assembly as recited in claim 1 wherein, the ground plane that is on the circuit board has unitary ground pads that are unitary with the ground plane that is on the circuit board, and the ground pins are connected to the unitary ground pads that are unitary with the ground plane that is on the circuit board.

6. An electrical cable assembly as recited in claim 5 wherein, the unitary ground pads that are unitary with the ground plane that is on the circuit board extend between the second contact pads that are on the second side of the circuit board, and the second contact pads that are on the second side of the circuit board extend beside and parallel to the unitary ground pads that are on the second side of the circuit board to control impedance.

7. An electrical cable assembly as recited in claim 6 wherein, the ground plane that is on the circuit board has first unitary ground pads that are unitary with the ground plane that is on the circuit board, the first unitary ground pads that are unitary with the ground plane that is on the circuit board extend between the first contact pads that are on the first side of the circuit board, the first contact pads that are on the first side of the circuit board extend beside and parallel to the first unitary ground pads that are unitary with the ground plane that is on the circuit board to control impedance, the ground plane that is on the circuit board has second unitary ground pads that are unitary with the ground plane that is on the circuit board, the second unitary ground pads that are unitary with the ground plane that is on the circuit board extend between the second contact pads that are on the second side of the circuit board, and the second contact pads that are on the second side of the circuit board extend beside and parallel to the unitary ground pads that are unitary with the ground plane that is on the circuit board to control impedance.

8. An electrical cable assembly as recited in claim 1 wherein, the electrical cable has conducting shields that encircle the signal transmitting conductors to provide coaxial cable constructions, and the conducting shields that encircle the signal transmitting conductors are connected to the ground plane that is on the circuit board.

9. An electrical cable assembly as recited in claim 8 wherein, the ground plane that is on the circuit board has unitary ground pads that are unitary with the ground plane that is on the circuit board, the unitary ground pads that are unitary with the ground plane that is on the circuit board extend between the second contact pads that are on the second side of the circuit board, and the second contact pads that are on the second side of the circuit board extend beside and parallel to the unitary ground pads that are on the second side of the circuit board to control impedance.

10. An electrical cable assembly as recited in claim 8 wherein, the ground plane that is on the circuit board has first unitary ground pads that are unitary with the ground plane that is on the circuit board, the first unitary ground pads that are unitary with the ground plane that is on the circuit board extend between the first contact pads that are on the first side of the circuit board, the first contact pads that are on the first side of the circuit board extend beside and parallel to the first unitary ground pads that are unitary with the ground plane that is on the circuit board to control impedance, the ground plane that is on the circuit board has second unitary ground pads that are unitary with the ground plane that is on the circuit board, the second unitary ground pads that are unitary with the ground plane that is on the circuit board extend between the second contact pads that are on the second side of the circuit board, and the second contact pads that are on the second side of the circuit board extend beside and parallel to the unitary ground pads that are unitary with the ground plane that is on the circuit board to control impedance.

11. An electrical cable assembly as recited in claim 8 wherein, the ground plane that is on the circuit board has unitary ground pads that are unitary with the ground plane that is on the circuit board, and the ground pins are connected to the unitary ground pads that are unitary with the ground plane that is on the circuit board.

12. An electrical cable assembly as recited in claim 11 wherein, the unitary ground pads that are unitary with the ground plane that is on the circuit board extend between the second contact pads that are on the second side of the circuit board, and the second contact pads that are on the second side of the circuit board extend beside and parallel to the unitary ground pads that are on the second side of the circuit board to control impedance.

13. An electrical cable assembly comprising:

an electrical cable connected to an electrical connector, a circuit board having a first side of the circuit board and first contact pads that are on the first side of the circuit board, the circuit board having a second side of the circuit board and second contact pads that are on the second side of the circuit board, the circuit board having a thickness of the circuit board and circuit paths that are on the thickness of the circuit board, the circuit paths that are on the thickness of the circuit board being connected to the first contact pads that are on a first side of the circuit board, and being connected to the second contact pads that are on the second side of the circuit board, the electrical connector having a housing of the electrical connector and having signal pins of the electrical connector and having ground pins of the electrical connector, the signal pins of the electrical connector being connected to the first contact pads that are on the first side of the circuit board, the electrical cable having insulated signal transmitting conductors of the electrical cable being connected to the second contact pads that are on the second side of the circuit board, whereby, the signal pins of the electrical connector are connected to the signal transmitting conductors of the electrical cable by having the signal pins of the electrical connector being connected to the first contact pads that are on the first side of the circuit board, and by having the first contact pads that are on the first side of the circuit board being connected to the conducting circuit paths that are on the thickness of the circuit board, and by having the conducting circuit paths that are on the thickness of the circuit board being connected to the second conducting pads that are on the second side of the circuit board, and by having the signal transmitting conductors of the electrical cable being connected to the second conducting pads that are on the second side of the circuit board, the circuit board having thereon a ground plane that is on the circuit board, the ground plane that is on the circuit board having first unitary ground pads that are unitary with the ground plane that is on the circuit board, the first unitary ground pads that are unitary with the ground plane that is on the circuit board extend between the first contact pads that are on the first side of the circuit board, the first contact pads that are on the first side of the circuit board extend beside and parallel to the first unitary ground pads that are unitary with the ground plane that is on the circuit board to control impedance, the ground plane that is on the circuit board having second unitary ground pads that are unitary with the ground plane that is on the circuit board, the ground pins of the electrical connector being connected to the second unitary ground pads that are unitary with the ground plane that is on the circuit board, the second unitary ground pads that are unitary with the ground plane that is on the circuit board extend between the second contact pads that are on the second side of the circuit board, and the second contact pads that are on the second side of the circuit board extend beside and parallel to the second unitary ground pads that are unitary with the ground plane that is on the circuit board to control impedance.

14. An electrical cable assembly as recited in claim 13 wherein, the electrical cable has conducting shields that encircle the signal transmitting conductors to provide coaxial cable constructions, and the conducting shields that encircle the signal transmitting conductors are connected to the ground plane that is on the circuit board.

15. An electrical cable assembly as recited in claim 14 wherein, the conducting circuit paths that on the thickness of the circuit board are on the thickness of the circuit board that is across an edge of the circuit board.

16. An electrical cable assembly as recited in claim 14 wherein, the conducting circuit paths that are on the thickness of the circuit board comprise conducting lining within apertures through the circuit board.

17. An electrical cable assembly comprising:

an electrical cable connected to an electrical connector, a circuit board having on a first side thereof first contact pads that are on the first side of the circuit board, the circuit board having on a second side thereof second contact pads that are on the second side of the circuit board, the electrical cable having insulated signal transmitting conductors connected to the second contact pads, the electrical connector having a housing of the electrical connector and ground pins of the electrical connector and signal pins of the electrical connector, the signal pins being connected to the first contact pads on the first side of the circuit board, the circuit board having on a thickness thereof circuit paths that connect to the first contact pads and to the second contact pads, whereby, the signal pins of the electrical connector are connected to the signal transmitting conductors of the electrical cable by the signal pins being connected to the first contact pads on the first side of the circuit board, and by the first contact pads being connected to the circuit paths on the thickness of the circuit board, and by the circuit paths being connected to the second contact pads on the second side of the circuit board, and by the signal transmitting conductors of the electrical cable being connected to the second contact pads, the circuit board having thereon a ground plane, and the ground pins of the electrical connector being connected to the ground plane.

18. An electrical cable assembly as recited in claim 17 wherein, the ground plane that is on the circuit board has unitary ground pads on the second side of the circuit board, the ground pins of the electrical connector are connected to the unitary ground pads on the second side of the circuit board, and the unitary ground pads extend between the second contact pads to which the signal transmitting conductors of the electrical cable are connected.

19. An electrical cable assembly as recited in claim 18 wherein, the ground plane that is on the circuit board has further unitary ground pads on the first side of the circuit board, the further unitary ground pads extend between the first contact pads on the first side of the circuit board, and whereby, to control impedance, the first contact pads extend beside and parallel to the further unitary ground pads, and the second contact pads extend beside and parallel to the unitary ground pads to which the signal transmitting conductors of the electrical cable are connected.

20. An electrical cable assembly as recited in claim 19, wherein, the electrical cable has conducting shields that encircle the signal transmitting conductors to provide coaxial cable constructions, and the conducting shields that encircle the signal transmitting conductors are connected to the ground plane that is on the circuit board.

* * * * *